US005128292A

United States Patent [19]

Lomas

[11] Patent Number: 5,128,292

[45] Date of Patent: Jul. 7, 1992

[54] SIDE MOUNTED COOLERS WITH IMPROVED BACKMIX COOLING IN FCC REGENERATION

[75] Inventor: David A. Lomas, Arlington Heights, Ill.

[73] Assignee: UOP, Des Plaines, Ill.

[21] Appl. No.: 608,939

[22] Filed: Nov. 5, 1990

[51] Int. Cl.[5] ..... B01J 38/30; B01J 38/32; B01J 29/38; C10G 11/18

[52] U.S. Cl. ..... 502/41; 208/164; 422/144; 502/44

[58] Field of Search ..... 502/41-44; 208/164

[56] References Cited

U.S. PATENT DOCUMENTS

| | | | |
|---|---|---|---|
| 2,436,927 | 3/1948 | Kassel | 502/42 |
| 2,463,623 | 3/1949 | Huff | 23/288 |
| 2,492,948 | 1/1950 | Berger | 252/417 |
| 2,506,123 | 5/1950 | Watson | 23/288 |
| 2,515,156 | 7/1950 | Jahnig et al. | 23/288 |
| 2,596,748 | 5/1952 | Watson et al. | 252/417 |
| 2,862,798 | 12/1958 | McKinney | 23/288 |
| 2,873,175 | 2/1959 | Owens | 23/288 |
| 2,970,117 | 1/1961 | Harper | 252/417 |
| 4,238,631 | 12/1980 | Daviduk et al. | 585/469 |
| 4,353,812 | 10/1982 | Lomas et al. | 252/417 |
| 4,396,531 | 8/1983 | Lomas | 252/417 |
| 4,424,192 | 1/1984 | Lomas et al. | 502/41 |
| 4,434,245 | 2/1984 | Lomas et al. | 502/41 |
| 4,439,533 | 3/1984 | Lomas et al. | 502/6 |
| 4,615,992 | 10/1986 | Murphy | 502/41 |
| 4,881,592 | 11/1989 | Cetinkaya | 502/41 |
| 4,923,834 | 5/1990 | Lomas | 502/44 |
| 4,960,503 | 10/1990 | Haun et al. | 208/164 |

*Primary Examiner*—Paul E. Konopka

*Attorney, Agent, or Firm*—Thomas K. McBride; John G. Tolomei

[57] ABSTRACT

The duty of a side-mounted, backmix type catalyst cooling zone is increasd by having one conduit that delivers catalyst to the top of the cooling zone and another conduit that uses fluidizing gas to vent catalyst from the top of the cooling zone back to a regenerator. The catalyst cooling zone is used to cool catalyst in a fluidized catalytic cracking process. The cooling zone comprises a heat exchanger located remote from an FCC regenerator that supplies hot catalyst particles to the cooling zone from a dense phase catalyst bed. Hot catalyst particles enter the top end of the cooling zone through a first conduit. Fluidizing gas, added to the cooling zone for backmixing and heat transfer purposes, exits the top of the cooling zone through a second conduit that communicates the top of the cooler with a dilute phase catalyst zone in the regenerator. Gas flow into and through the second conduit transports catalyst from the cooling zone to the regenerator. In order to minimize any flow of fluidizing gas up the first conduit, a gas collection zone can be maintained in the upper end of the cooling zone.

7 Claims, 1 Drawing Sheet

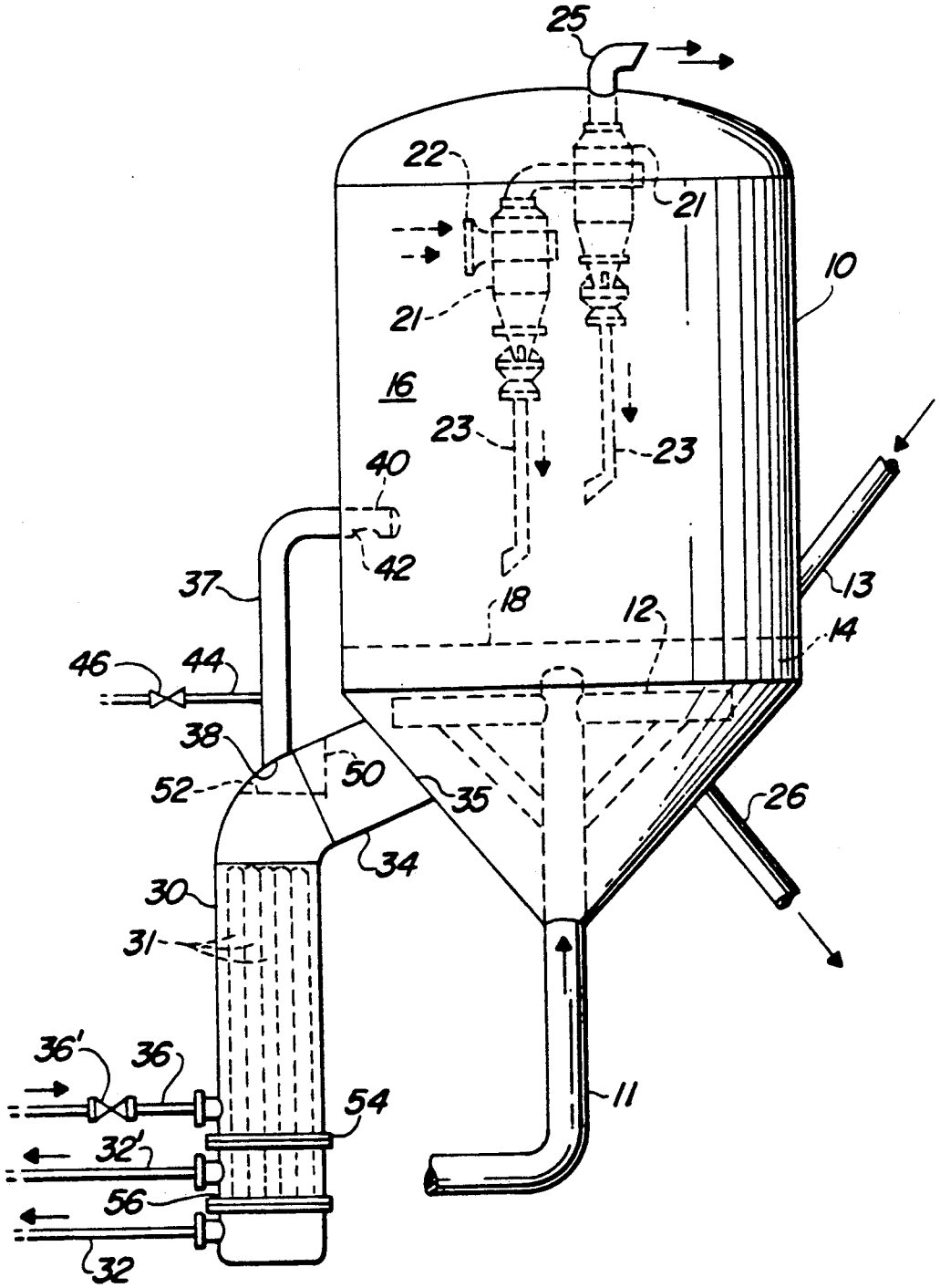
25
22
21
10
21
16
23
23
40
42
37
18
12
13
14
46
44
38
52
50
35
26
34
30
31
36'
36
54
11
32'
56
32

SIDE MOUNTED COOLERS WITH IMPROVED BACKMIX COOLING IN FCC REGENERATION

CROSS-REFERENCE TO RELATED APPLICATIONS

This application relates to subject matter of U.S. Pat. No. 4,923,834 which was issued on May 5, 1990.

BACKGROUND OF THE INVENTION

The field of art to which this invention pertains is the cooling of fluidized particles. It particularly relates to the combustion of combustible material from a particulated solid such as fluidized catalyst which has been at least partially deactivated by the deposition thereon of a combustible material, such as coke and the cooling of such particles in a vessel that is separate and distinct from the vessel in which such combustion takes place. The present invention will be most useful in a process for regenerating coke-contaminated particles of fluidized cracking catalyst, but it should find use in any process in which combustible material is burned from solid, fluidizable particles.

DESCRIPTION OF THE PRIOR ART

The fluid catalyst cracking process (hereinafter FCC) has been extensively relied upon for the conversion of starting materials, such as vacuum gas oils, and other relatively heavy oils, into lighter and more valuable products. FCC involves the contact in a reaction zone of the starting material, whether it be vacuum gas oil or another oil, with a finely divided, or particulated, solid, catalytic material which behaves as a fluid when mixed with a gas or vapor. This material possesses the ability to catalyze the cracking reaction, and in so acting it is surface-deposited with coke, a by-product of the cracking reaction. Coke is comprised of hydrogen, carbon and other material such as sulfur, and it interferes with the catalytic activity of FCC catalyts. Facilities for the removal of coke from FCC catalyst, so-called regeneration facilities or regenerators, are ordinarily provided within an FCC unit. Coke-contaminated catalyst enters the regenerator and is contacted with an oxygen containing gas at conditions such that the coke is oxidized and a considerable amount of heat is released. A portion of this heat escapes the regenerator with the flue gas, comprised of excess regeneration gas and the gaseous products of coke oxidation. The balance of the heat leaves the regenerator with the regenerated, or relatively coke free, catalyst.

The fluidized catalyst is continuously circulated from the reaction zone to the regeneration zone and then again to the reaction zone. The fluid catalyst, as well as providing catalytic action, acts as a vehicle for the transfer of heat from zone to zone. Catalyst exiting the reaction zone is spoken of as being "spent", that is partially deactivated by the deposition of coke upon the catalyst. Catalyst from which coke has been substantially removed is spoken of as "regenerated catalyst".

The rate of conversion of the feestock within the reaction zone is controlled by regulating of the temperature, activity of catalyst and quantity of catalyst (i.e. catalyst to oil ratio) therein. The most common method of regulating the reaction temperature is by regulating the rate of circulation of catalyst from the regeneration zone to the reaction zone which simultaneously increases the catalyst/oil ratio. That is to say, if it is desired to increase the conversion rate, an increase in the rate of flow of circulating fluid catalyst from the regenerator to the reactor is effected. Inasmuch as the temperature within the regeneration zone under normal operations is considerably higher than the temperature within the reaction zone, this increase influx of catalyst from the hotter regeneration zone to the cooler reaction zone effects an increase in reaction zone temperature.

It has become important for FCC units to have the capability to cope with feedstocks such as residual oils and possibly mixtures of heavy oils with coal or shale derived feeds.

The chemical nature and molecular structure of the feed to the FCC unit will affect that level of coke on spent catalyst. Generally speaking, the higher the molecular weight, the higher the Conradson carbon, the higher the heptane insolubles, and the higher the carbon to hydrogen ratio, the higher will be the coke level on the spent catalyst. Also, high levels of combined nitrogen, such as found in shale derived oils, will also increase the coke level on spent catalyst. The processing of heavier and heavier feedstocks, and particularly the processing of deasphalted oils, or direct processing of atmospheric bottoms from a crude unit, commonly referred to as reduced crude, does cause an increase in all or some of these factors and does therefore cause an increase in coke level on spent catalyst.

This increase in coke on spent catalyst results in a larger amount of coke burned in the regenerator per pound of catalyst circulated. Heat is removed from the regenerator in conventional FCC units in the flue gas the and principally in the hot regenerated catalyst stream. An increase in the level of coke on spent catalyst will increase the temperature difference between the reactor and the regenerator, and in the regenerated catalyst temperature. A reduction in the amount of catalyst circulated is therefore necessary in order to maintain the same reactor temperature. However, this lower catalyst circulation rate required by the higher temperature difference between the reactor and the regenerator will result in a fall in conversion, making it necessary to operate with a higher reactor temperature in order to maintain conversion at the desired level. This will cause a change in yield structure due to an increase in thermal versus catalytic selectivity which may or may not be desirable, depending on what products are required from the process. Also there are limitations to the temperatures that can be tolerated by FCC catalyst without there being a substantial detrimental effect on catalyst activity. Generally, with commonly avaiable modern FCC catalyst, temperatures of regenerated catalyst are usually maintained below 1400° F., since loss of activity would be very severe at about 1400°-1450° F. If a relatively common reduced crude such as that derived from Light Arabian crude oil were charged to a conventional FCC unit, and operated at a temperature required for high conversion to lighter products, i.e., similar to that for a gas oil change, the regenerator temperature would operate in the range of 1600°-1800° F. This would be too high a temperature for the catalyst, require very expensive materials of construction, and give an extremely low catalyst circulation rate. It is therefore accepted that when materails are processed that would give excessive regenerator temperatures, a means must be provided for removing heat from the regenertor, which enables a lower regenerator temperature, and a lower temperature difference between the reactor and the regenerator.

The prior art is replete with disclosures of FCC processes which utilize dense or dilute phase regenerated fluid catalyst heat removal zones or heat exchangers that are remote from and external to the regenerator vessel to cool hot regenerated catalyst for return to the regenerator. Examples of such disclosures are as set forth in Daviduk et al. 4,238,631; Harper U.S. Pat. No. 2,970,117; Owens U.S. Pat. No. 2,873,175; McKinney U.S. Pat. No. 2,862,798; Watson et al. U.S. Pat. No. 2,596,748; Jahnig et al. U.S. Pat. No. 2,515,156; Berger U.S. Pat. No. 2,492,948; Watson U.S. Pat. No. 2,506,123; Lomas et al. 4,353,812; and Lomas et al. U.S. Pat. No. 4,439,533. At least one of the above U.S. patents (Harper) discloses that the rate of return of the cooled catalyst to the regenerator may be controlled by the regenerator (dense catalyst phase) temperature.

An important consideration in the above FCC processes involving regenerator heat removal is the method of control of the quantity of heat removed. In Harper U.S. Pat. No. 2,970,117 and Huff U.S. Pat. No. 2,463,623, the sole method involves regulation of the rate of flow of regenerated catalyst through external catalyst coolers. This method of heat removal, utilizing external coolers and varying the rate of catalyst circulation through them as the exclusive means of control of the heat exchanger duty, involves the continual substantial changing of the catalyst loading on the regenerator with the associated difficulty or impossibility of maintaining convenient steady state operations. In an improved method of using a remote cooler, disclosed in Lomas et al. U.S. Pat. No. 4,353,812, the heat transfer coefficient across the heat transfer surface is controlled by varying the catalyst density through regulation of fluidizing gas addition. The '812 reference also shows the use of a vent line at the top of the catalyst cooler in addition to a catalyst withdrawal line. U.S. Pat. No. 4,615,992, issued to Murphy, also shows the use of a vent line to transfer relatively catalyst-free gas from the top of a remote catalyst cooler to a regenerator vessel. In both cases the cooler receives a high catalyst flux (catalyst flux is the weight of catalyst flowing through a given cross-section per unit of time) through the standpipe feeding the cooler which prevents a catalyst and air mixture from flowing countercurrently up the standpipe. One method of control that has been purposefully avoided in the operation of most heat removal zones is the circulation rate of cooling medium. In order to prevent overheating and possible failure of the cooling tubes, cooling medium usually circulates through the tubes at a high and constant rate. Therefore, the most common form of catalyst coolers uses a net flow of catalyst through the cooler and for this reason is termed a flow through cooler. Heat transfer in these flow through coolers is controlled by regulating the net flow or inventory of catalyst either alone or in combination with regulation of the fluidization gas addition.

The principle of controlling heat removal with fluidizing gas addition is used in Lomas U.S. Pat. No. 4,439,533 to operate what is herein referred to as a backmixed cooling zone. In a backmixed cooling zone, catalyst to be cooled circulates in and out of a cooler inlet opening without a net transport of catalyst through the cooler. The difference between a flow through cooler operation and a backmix cooler operation is that in the backmix operation all of the catalyst circulation into and out of the cooler is through the same opening whereas in a flow through operation catalyst is transported in at least one direction down the length of the cooler. U.S. Pat. No. 2,492,948, issued to C. V. Berger, depicts a catalyst cooler that communicates with the lower portion of an FCC regenerator and superficially resembles a backmix type cooler; however, Berger is really a flow through type cooler since it receives catalyst through an annular opening, transports catalyst down an internal annular passage, transports catalyst up through a heat transfer passage, and ejects catalyst from a central opening. The addition rate of fluidizing gas to the catalyst is the sole variable for controlling the amout of heat transfer in the backmix type cooler. The fluidizing gas addition rate controls the heat transfer coefficient between the catalyst and the cooling surface and the turbulence within the cooler. More turbulence in the backmix cooler promotes more heat transfer by increasing the interchange of catalyst at the cooler opening and increasing the average catalyst temperature down the length of the cooler. A remote backmix cooler has the advantage of a simple design and is readily adapted to most FCC configurations since it requires a single opening between the regenerator and the cooler. Unfortunately, backmix coolers often have the drawback of lower heat transfer duty in comparison to flow through type coolers, especially in the case of backmix coolers that are horizontally displaced from a regeneration vessel.

It has now been recognized that the horizontal displacement of a remote catalyst cooler from a regenerator vessel interferes with the exchange of catalyst across the cooler inlet opening. Furthermore, it has been discovered that the problem of catalyst exchange across the opening for backmix operations of a horizontally displaced catalyst cooler can be overcome by a specific arrangement and use of the catalyst cooler and a valveless catalyst transport line.

SUMMARY OF THE INVENTION

In brief summary, this invention is a method and apparatus for increasing the circulation of hot particles from a dense bed in a regeneration zone to a remote cooling zone that is horizontally displaced from the regeneration zone and operates at least partially in a backmix mode. This invention increases catalyst circulation to the top of the cooler by using fluidizing gas to transfer catalyst from the upper portion of the cooler through a passage that is separate and distinct from the passage supplying hot particles to the cooler thereby increasing heat removal for backmix operations of the cooler. By this invention, heat removal for backmix cooler operations is brought to its highest level with the addition of very little hardware.

Accordingly in one embodiment, this invention is a process for regenerating coke-contaminated fluidized catalyst particles. This process includes the steps of maintaining a first bed of fluidized catalyst, communicating hot catalyst from the first bed across a horizontal distance through a first passage to the top of a vertically-oriented cooling zone, and maintaining particles in the cooling zone as a second bed by passing a fluidizing gas upwardly through the second bed. Heat is withdrawn from the particles in the second bed by indirect heat exchange with a cooling flud. Fluidizing gas and catalyst are removed from the top of the vertically-oriented cooling zone through a second passage and catalyst is returned from the cooler to the dense phase bed through the second passage.

A highly preferred embodiment of this invention uses the cooling process of this invention for the regeneration of catalyst particles in an FCC operation.

Other embodiments of the present invention encompasses further details such as process streams and the function and arrangement of various components of the apparatus, all of which are hereinafter disclosed in the following discussion of each of the facets of the invention.

BRIEF DESCRIPTION OF THE DRAWING

The figure is an elevation view of a regeneration apparatus according to one embodiment of the present invention, showing a regeneration zone and a cooling zone (heat exchanger).

The above-described drawing is intended to be schematically illustrative of the present invention and not a limitation thereon.

DETAILED DESCRIPTION OF THE INVENTION

The present invention, in it process aspects, consists of steps for the cooling of fluidized particulate materials. An important application of the invention will be a process for the combustion of a combustible material from fluidized particles containing the combustible material, including the step of introducing oxygen containing combustion gas and the fluidized particles into a combustion zone maintained at a temperature sufficient for oxidation of the combustible material. The combustible material will be oxidized therein to produce hot fluidized particles which are then cooled by the process of the invention.

The combustion zone wil be located in a regeneration vessel In the regeneration vessel gas will pass upwardly through catalyst located therein so that the entire regenerator vessel contains a fluidized regeneration zone. A dense phase catalyst bed will be maintained in a lower portion of the vessel and a dilute phase catalyst zone will be maintained in an upper portion of the regeneration vessel. Coke combustion can take place in both the dense phase or the dilute phase therefore the term combustion zone can refer to dense bed or the dense bed and dilute phase. However, it is generally preferred that coke combustion take place in the dense bed section. The dilute phase above the dense bed provides a regenerated catalyst disengaging zone for the separation of catalyst particles from the upwardly flowing gases. The dilute phase and dense bed regions of the regenerator are distinct regions of the regenerator that are separated by a definite boundary that forms at the upper end of the dense bed.

Dense or dilute phase conditions refer to the density of the catalyst and gas mixture in various sections of the FCC process. The actual density of the flowing catalyst and gas mixture will be dependent on both catalyst flux and superficial gas velocity. Dense phase conditions will typically refer to conditions greater than 30 lbs/ft$^3$ with dilute phase being less than 20 lbs/ft$^3$. Gas and catalyst mixtures having a density of 20 to 30 lbs/ft$^3$ can be considered either dense or dilute.

In general this invention will be in an FCC process that includes steps for the regenerative combustion, within a combustion zone, of a coke containing FCC catalyst, from a reaction zone, to form hot flue gas and hot regenerated catalyst, disengagement and collection of the hot regenerated catalyst, cooling of the hot regenerated catalyst in a heat removal or cooling zone, and the use of at least a portion of the cooled regenerated catalyst for control of the temperatures of the catalyst returning to the reaction zone. As used herein, the term "hot regenerated catalyst" means regenerated catalyst at the temperature leaving the combustion zone, usually from about 1300° to about 1400° F., while the term "cool regenerated catalyst" means regenerated catalyst at the temperature leaving the cooling zone, the latter of which is up to 200° F. less than the temperature of the hot regenerated catalyst.

An important feature of this invention is the arrangement of the passages for communicating catalyst between the cooling zone and the regeneration zone and the location of these passages in relation to the top level of the dense bed and the cooling zone. This invention is most useful for side by side arrangements of the regenerator vessel and cooling zone. The cooling zone is remote from the regeneration vessel and housed in a distinct cooling vessel having a vertical orientation. In such arrangements there must be at least two passageways for communicating catalyst across the horizontal distance between the regeneration vessel and the cooling zone. One passageway must communicate with the regeneration vessel at a location that is below the upper level of the dense bed. The other passageway must have one end that communicates with the regeneration vessel at a location that is above the upper level of the dense bed and the other end communicating with the upper end of the cooling zone. the zones of the regenerator are separated by a dense bed.

The cooling zone may be operated in a complete backmix mode wherein the hot regenerated catalyst is continously circulated through the combustion zone with no net downward movement of catalyst through the cooling zone or a partial flow through mode so that a portion of the catalyst entering the cooling zone passes through the combustion zone. However, this invention is most advantageous when used in a complete backmix mode with a cooler having a lower end that is completely closed to catalyst flow.

Reference will now be made to the attached drawing for a discussion of examples of the regeneration process embodiment and associated apparatus of the invention. In the Figure, regeneration gas, which may be air or another oxygen-containing gas, enter a vessel 10 through a line 11, and is distributed by an air distribution grid 12. Air leaving the grid mixes with coke-contaminated catalyst entering the combustion zone through a conduit 13. These streams are shown as flowing separately into the vessel 10; however, each stream could flow together into a mixing conduit then enter vessel 10 together as a combined stream.

Coke-contaminated catalyst commonly contains from about 0.1 to about 5 wt. % carbon, as coke. Coke is predominantly comprised of carbon, however, it can contain from about 3 to about 15 wt. % hydrogen, as well as sulfur and other materials.

The regeneration gas and catalyst form a dense bed 14 and a dilute phase 16 in the regeneration vessel 10. Catalyst that enters the regeneration vessel is fluidzed by the gas that enters through the grid 12. The superficial velocity of the gas as it flows upward is kept below about 3.5 ft/second to form dense bed 14. Dense bed 14 has a top level 18. The elevation of level 18 is determined by the inventory of catalyst in the regeneration vessel and the superficial gas velocity through the regenerator vessel. Increasing the superficial gas velocity in the regenerator, for a given quantity of catalyst will raise the dense phase/dilute phase interface 18 by lowering the density of the bed 14. As the gas passes above the upper bed level 18 it entrains catalyst that is carried into dilute phase 16. As the catalyst particles and gas mixture flow up through the regenerator vessel in dilute phase 16 some of the particles will return to dense bed 14, therefore, this dilute phase is also known as a disengagement zone.

The gaseous products of coke oxidation and any excess regeneration gas that passes upward in the dilute phase is known as flue gas. The small uncollected portion of hot regenerated catalyst that flows with the flue gas through disengagement zone 18 enters catalyst/gas separators such as cyclones 21 through an inelt 22. The flue gas exits regeneration vessel 10 via conduit 25, through which it may proceed to associated energy recovery systems. Catalyst separated from the flue gas falls from the cyclones through dip legs 23 to the dense bed 14.

Catalyst in the lower portion of bed 14 is essentially free of carbon deposits. Such catalyst is generally referred to as regenerated catalyst. Regenerated catalyst is withdrawn from dense bed 14 by a conduit 26 that transfers the regenerated catalyst from the regeneration vessel to a reaction zone.

With further reference to the Figure, the cooler or cooling zone is comprised of a heat exchanger 30 having a vertical orientation, the catalyst present on the shell side of the exchanger and a heat exchange medium, supplied by lines 32 and 32', passing through a tube bundle 31. The preferred heat exchange medium would be water, which, in further preference, would change only partially from liquid to a gas phase (steam) when passing through the tubes. It is also preferably to operate the heat exchanger so that the exchange medium is circulated through the tubes at a constant rate. The tube bundle in the heat exchanger will preferably be of the "bayonet" type wherein one end of the bundle is unattached, thereby minimizing problems due to the expansion and contraction of the heat exchanger components when exposed to and cooled from the high regenerated catalyst temperatures. The heat transfer that occurs is, from the catalyst, through the tube walls, and into the heat transfer medium. The top of the exchanber 30 is in sealed communication with the dense bed 14 through a passageway shown in the Figure as conduit 34. Catalyst entering or exiting conduit 34 passes through a cooler opening 35. That portion of conduit 34 which is located immediately above bayonet tubes 31 serves as a closer for the upper end of the cooler. The level 18 of dense bed 14 will be kept above opening 35 so that the catalyst may freely backmix and circulate throughout the inside of the exchanger 30 and the bottom of the disengagement zone. Fluidizing gas, preferably air, is passed into a lower portion of the shell side of heat exchanger 30 via line 36, thereby maintaining a dense phase fluidized catalyst bed on the shell side of the exchanger 30. Fluidizing gas may be introduced at one or more points in the shell in addition to that shown. A valve 36' positioned across line 36 regulates the flow fluidizing gas. The fluidizing gas effects turbulent backmixing and an exchange of catalyst particles between dense bed 14 and the exchanger 30.

In order to increase the flow of hot catalyst particles into the upper end of exchanger 30, fluidizing gas is vented from the top of the heat exchanger by another passageway in the form of conduit 37. This invention arranges the cooler and its passageway so tha the venting of gas out of the top of the exchanger 30 will also transport catalyst out of the exchanger. Conduit 37 has an opening 38 at the cooler end of the conduit that communicates with the upper end of the cooler. The other end of conduit 37 has a regenerator end 40 that discharges catalyst into the dilute phase 16 of the regeneration vessel. Regenerator end 40 directs the fluidizing gas and catalyst downward through an opening 42. Fluidizing gas leaving opening 42 flows into the disengagement zone where it ultimately leaves the system with the flue gases.

A catalyst head resulting from different catalyst densities provides the necessary driving force to return significant amounts of catalyst to the regenerator through conduit 37. Dense bed level 18 is located above opening 38 so that ther will always be an available head of catalyst to drive catalyst into the conduit 37. The smaller diameter of conduit 37 relative to exchanger 30 creates a raises the superficial gas velocity as fluidizing gas passes from the exchanger to conduit 37. A higher superficial velocity in conduit 37 lowers the density of the catalyst therein and the higher pressure created by dense catalyst in bed 14 relative to the pressure created by the catalyst in conduit 37 drives fluidized catalyst upward through conduit 37. In this manner the conduit 37 directly increases the circulation of catalyst through a backmix cooler.

The conduit 37 also increases the catalyst circulation to the upper end of the heat exchanger by eliminating the flow of fluidizing gas along the upper surface of conduit 34, which would occur in the absence of conduit 37 and usually takes the form of large slugs of fluidizing gas. These slugs of fluidizing gas are much different than the discrete bubbles that form in the vertical section of the cooler and are much less efficient in particle mixing interchange than the discrete bubbles.

The direct transport of catalyst through conduit 37 occurs in at least dilute phase, i.e., catalyst at a density of at least 2 $lbs/ft^3$, from the exchanger into dilute phase 16. The type of catalyst transport in conduit 37 will be determined by catalyst flux and superficial gas velocities and will include dense as well as dilute phase catalyst transport. Additional air may be added to the conduit 37 by air inlet 44 to aid and control the transport of catalyst through conduit 37. Valve 46 is used to regulate the addition of fluidizing gas through air inlet 44. The flow of catalyst through conduit 37 is controlled by varying the density of the catalyst in conduit 37 through regulation of the addition of fluidizing gas. Adding additional fluidizing gas to the conduit 37 increases the catalyst circulation about the upper end of the heat exchanger and allows catalyst circulation to be controlled in conduit 37 to about the same degree that a slide valve can control catalyst flow in a downflow line.

Increasing the flow of hot catalyst particles to the upper end of the heat exchanger raises the catalyst temperatures throughout the exchanger 30, but most beneficially in the lower portions of the heat exchanger. Higher temperature catalyst in lower sections of the heat exchanger increases the heat removal duty of the heat exchanger. In addition, with a higher temperature profile in lower sections of the heat exchanber, longer exchanger lengths can be effectively used to further increase the heat removal capacity.

It is known that backmixing can be obtained within the heat exchanger at reasonable superficial gas velocities to circulate catalyst between the cooling zone and disengaging zone. The addition of fluidizing gas or air affects the heat transfer coefficient directly by affecting the superficial velocity over the heat exchanger tubes and indirectly by influencing the extent of mass flow of catalyst from the disengagement zone through the heat exchanger. The higher mass flow will also result in a higher heat exchanger duty because the average catalyst temperature in the heat exchanger will be higher thereby providing a higher temperature difference ($\Delta T$) to which the amount of heat transfer is directly proportional. Additional details on the operation of a backmix cooling zone can be found in U.S. Pat. No. 4,439,533. In this invention, the air addition rate also controls the amount of catalyst circulation in conduit 37. Increasing the air addition rate brings more hot catalyst into the cooling zone and further increases the heat exchanger duty.

In one form of the invention a baffle 50, extends downwardly from and transversely across an upper section of conduit 34 as shown in the Figure. Baffle 50 is located between the opening 38 and opening 35. Baffle 50 further segregates the fluidizing gas leaving the exchanger from catalyst entering the exchanger. Segregation of the fluidizing gas can be used to form an interface or an upper bed level 52 between an upper dilute catalyst phase that extends into conduit 37 and a lower dense catalyst phase. In this way, baffle 50 can form a compartment to collect fluidizing gas and aid in the transfer of catalyst througg conduit 37 thereby minimizing the need for the addition of fluidizing gas via air inlet 44. Segregating the fluidizing gas with baffle 50 also keeps fluidizing gas away from the inlet 35 thereby increasing the net catalyst flow into the heat exchanger and reducing the required diameter of conduit 34. Although baffle 50 will increase catalyst flow into the heat exchanger, substantial benefits are still obtained by the addition of conduit 37 alone.

The conduit 34 need not communicate with the top of the cooler if there is no backmix of catalyst particles through conduit 34 and all of the catalyst from the cooler flows back into the regenerator vessel by conduit 37. When all of the outward flow catalyst from the cooler is through conduit 37, the lower end of conduit 34 may discharge into the middle or lower portion of the cooler.

Heat exchanger 30 may also be operated with some net downward movement of catalyst. This type of operation is referred to as a flow through mode. To the degree that the exchanger is operated in the flow through mode, cool catalyst is withdrawn from a lower portion of exchanger 30 and returned to the regeneration vessel 10. Catalyst can be withdrawn from a lower portion of the exchanger through a conduit having a flow control valve place therein to regulate the transport catalyst. In such configurations a riser conduit is usually need to transport catalyst into the regenerator. The arrangement of this invention allows a complete backmix operation to be used for the hear exchanger so that extra transport conditions and control valves may be eliminated.

The tube bundle 31 is of the aforementioned bayonet type in which the tubes are attached at the bottom or "head" of the heat exchanger 30, but not at any other location. A typical configuration of tubes in the bayonet-type bundle would be one-inch tubes each ascending from an inlet manifold 54 in the head of the exchanger up into the shell of the exchanger through a three inch tube. Each three-inch tube is sealed at its top and each one-inch tube empties into the three-inch-tubes in which it is contained just below the sealed end of the three inch tube. A liquid, such as water, would be passed up into the one inch tubes, would empty into the three-inch tubes, would absorb heat from the hot catalyst through the wall of the three-inch tubes as it passed downward through the annular space of the three-inch tubes and would exit the heat exchanger, at least partially vaporized, from outlet manifold 56 in the head.

Although the Figure illustrates a single heat exchanger with associated circulating catalyst conduit, it should be understood that other configurations are possible, such as two heat exchanges, of the design illustrated, side by side with the conduit 49 between them.

The backmix mode of cooling zone operation as practiced in this invention reduces the temperature of catalyst near the discharge point of opening 42 and, when there is substantial backmixing through conduit 34, outlet 35. Therefore, this invention can also be used to locally cool selected regions of the dense catalyst bed by horizontally displacing the location of opening 42 relative to opening 35. Having openings 35 at 42 at different location allows relatively cool catalyst to be directed from opening 42 into a desired location around the periphery of the regeneration vessel. For example, it is often desirable to cool the regenerated catalyst that will be withdrawn and transferred to the reaction zone. By discharging catalyst from opening 42 over the are the regenerated bed where catalyst is withdrawn for the reaction zone, relatively cooler catalyst particles can be transferred to the reaction zone. Furthermore the relative temperature in different areas of the catalyst bed can be controlled by adjusting the amount of catalyst that is returned to the regenerator vessel from the cooler by backmixing along conduit 34 and transfer through conduit 37. In order to obtain the benefits of localized cooling it is not necessary that opening 35 and 42 be 180° apart, some degree of localized cooling can be obtained by merely locating openings 35 and 42 in different quadrants of the usually circular regenerator cross section. In addition, the effectiveness of this localized cooling can be enhanced by the use of appropriate baffling in the regenerator to further isolate cooled catalyst from the rest of the catalyst in the dense bed 14.

The following examples demonstrate the increased heat removal capacity that can be obtained by the addition of a conduit and transport air to vent the upper end closure of a catalyst cooler. In both these examples, a regenerator having the general configuration shown in the drawing is operated to regenerate a catalyst with the cooling zone operating in a complete backmix mode (i.e., valve 73 is closed). In both cases, a zeolitic type catalyst having coke in an amount of 0.9 wt. % enters the regenerator combustor at the same rate and at a temperature of 980° F.

EXAMPLE I

This example represents a pior art type process wherein catalyst from the regenerator vessel is circulated through the cooling zone via a single conduit. Catalyst enters the regeneration vessel where it is contacted with air and spent catalyst from the reaction zone. After combustion of coke in the regeneration zone, the catalyst and gas mixture has an average temperature of about 1340° F. A portion of the catalyst from the dense bed of the regeneration zone is circulated into a remote cooling zone.

The cooling zone consists of a heat exchanger having bayonet tubes. Air at a rate of 720 SCFM enters the bottom of the heat exchanger. The air travels upward through the exchanger and into the disengaging zone through the same conduit by which the catalyst enters the heat exchanger. Water is circulated through the bayonet tubes at a constant rate to remove heat from the catalyst by indirect heat exchange across the outer surface of the bayonet tubes at a duty of $3\times10^6$ Btu/hr.

Catalyst from the cooling zone returns to the dense bed of the regeneration zone. Catalyst is withdrawn from the regeneration zone at an average temperature of 1340° F. for return to a reaction zone.

EXAMPLE II

Example II represents the process of this invention wherein catalyst from a regeneration zone enters a cooling zone through one conduit and fluidizing gas and catalyst in dilute phase is vented from the top of the cooling zone by another conduit. Again catalyst enters the regeneration zone where it is contacted with air and spent catalyst from the regeneration zone. After combustion of coke in the regeneration zone, the catalyst and spent regeneration gas mixture enters the catalyst in the regeneration zone has an average temperature of 1270° F. A portion of the catalyst from the dense bed of the regeneration zone enters a remote cooling zone.

The cooling zone consists of a heat exchanger having bayonet tubes. Air at a rate of 720 SCFM enters the bottom of the heat exchanger. The air travels upward through the exchanger and out of the cooling zone through a conduit that communicates the top of the cooling zone with a dilute phase section of the regeneration zone. Water is circulated through the bayonet tubes at the same rate as Example I to remove heat from the catalyst by indirect heat exchange across the outer surface of the bayonet tubes. In this example, the heat exchanger has a duty of 55—$10^6$ Btu/hr. Catalyst from the cooling zone is carried to the dilute phase section of the regeneration zone. Catalyst is withdrawn from the regeneration zone at an average temperature of 1270° F. for return to the reaction zone.

A comparison between the two examples demonstrates the advantages of this invention. By the addition of single conduit for communicating the top of the cooling zone with the dilute phase of the regeneration vessel, the cooler duty was increased 83.0%. The only additional cost associated with obtaining this benefit is the relatively minor cost of the conduit. The fluidizing gas for transporting catalyst from the cooling zone to the dilute phase did not add any cost since the air rate to the cooling zone was the same in Examples I and II.

What is claimed is:

1. A process for regenerating fluidized cracking catalyst for use in a catalytic cracking reaction zone said process comprising:

a) introducing an oxygen-containing regeneration gas and coke-contaminated fluidized catalyst into a first bed of catalyst in a fluidized regeneration zone maintained at a temperature sufficient for coke oxidation and therein oxidizing coke to produce hot regenerated catalyst and hot flue gas;

b) separating said hot flue gas and said hot regenerated catalyst in a regenerated catalyst disengaging zone located above said first catalyst bed;

c) withdrawing regenerated catalyst from said first bed and transporting said regenerated catalyst to said fluidized catalytic cracking reaction zone;

d) communicating catalyst from said first bed through a first passage across a horizontal distance into a second bed of catalyst located in a remote and vertically-oriented cooling zone;

e) passing a fluidizing gas upwardly through said cooling zone, and maintaining a dense catalyst phase having a density greater than 20 lb/ft$^3$ in said second bed;

f) operating said vertically-oriented cooling zone in an essentially complete backmix mode to exchange catalyst between said second bed and said cooling zone and remove heat from said catalyst by indirect heat exchange with a cooling fluid in said cooling zone and produce relatively cool regenerated catalyst in said cooling zone and said second bed; and g) withdrawing a mixture of fluidizing gas and catalyst, from said second bed at a location below the top of said first bed through a second passage and returning particles from said second passage to said first bed said mixture of fluidizing gas and catalyst having a density of at least 2 lb/ft$^3$.

2. The process of claim 1 wherein said first bed has an average density greater than 20 lb/ft$^3$, a dilute catalyst phase having a density of from 2–20 lb/ft$^3$ is maintained above said first fluidized bed and said second passage returns catalyst to said dilute catalyst phase above said first dense bed.

3. The process of claim 1 wherein catalyst flow out of said cooler is only through said first or second passage.

4. The process of claim 1 wherein additional fluidizing gas enters said second passageway at a location above said second bed and the flow of catalyst through said second passageway is controlled by varying the amount of said additional fluidizing gas entering said second passageway above said second bed.

5. The process of claim 1 wherein a compartment containing dilute phase catalyst is formed in an upper portion of said cooler below said second passage and the top of said first bed.

6. The process of claim 5 wherein said compartment is formed by blocking the upper cross-section of said first conduit.

7. The process of claim 1 wherein said first passageway communicates with said first bed in a first quadrant of the horizontal cross section of said first bed and said particles from said second passage are returned to a different quadrant of the horizontal cross section of said first bed.

* * * * *